United States Patent [19]

Petrini et al.

[11] Patent Number: 4,561,196

[45] Date of Patent: Dec. 31, 1985

[54] SKI BOOT HAVING UPPER WITH JOURNALLED DISTRIBUTION PLATE

[75] Inventors: Roland Petrini, Chambéry; Jean-Louis De Marchi, Faverges, both of France

[73] Assignee: Salomon S.A., Annecy, France

[21] Appl. No.: 376,653

[22] Filed: May 10, 1982

[30] Foreign Application Priority Data

May 22, 1981 [FR] France ..... 81 10671

[51] Int. Cl.[4] ..... A43B 5/04

[52] U.S. Cl. ..... 36/118; 36/120

[58] Field of Search ..... 36/117–121, 36/54

[56] References Cited

U.S. PATENT DOCUMENTS

| | | | |
|---|---|---|---|
| 3,619,914 | 11/1971 | Hanson et al. . | |
| 3,729,841 | 5/1973 | Wagner | 36/120 |
| 3,732,635 | 5/1973 | Marker | 36/120 |
| 4,083,127 | 4/1978 | Hanson | 36/117 X |
| 4,104,811 | 8/1978 | Salomon | 36/121 |
| 4,280,286 | 7/1981 | Sartor | 36/118 |
| 4,282,660 | 8/1981 | Hanson | 36/121 |

FOREIGN PATENT DOCUMENTS 2410063 9/1974 Fed. Rep. of Germany .

*Primary Examiner*—James Kee Chi

*Attorney, Agent, or Firm*—Sandler & Greenblum

[57] ABSTRACT

A ski boot has a rigid base shell which is adapted to surround the foot of a skier and an upper adapted to surround the bottom of the leg of the skier. The upper is journalled along a first axis on said shell base and comprises at least two portions, one of which is in the form of a distribution plate journalled to the front cuff portion of the upper along a second, distinct axis. The distribution platé distributes the contact pressure which is normally created between the leg of the skier and the front upper edge of the cuff over a front upper zone of the cuff to enhance the comfort of the skier. The distribution plate helps to compensate for the difference in the angle of movement of the leg of a skier and of the upper when the skier exerts a forward flexion force while skiing.

37 Claims, 16 Drawing Figures

FIG. 1.
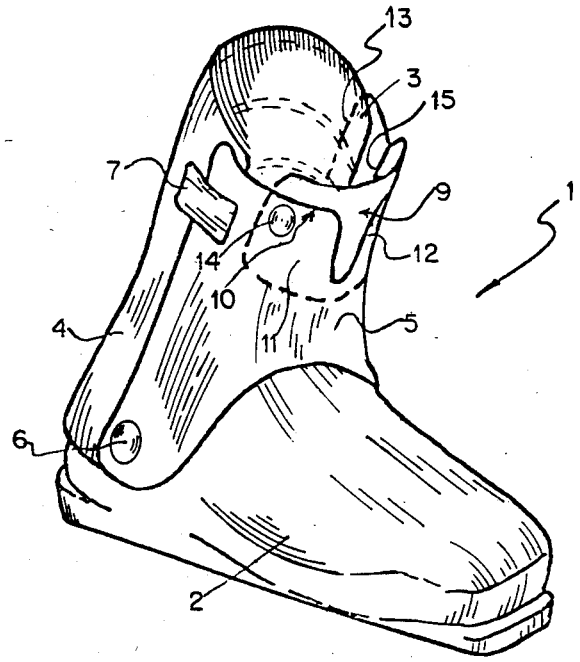
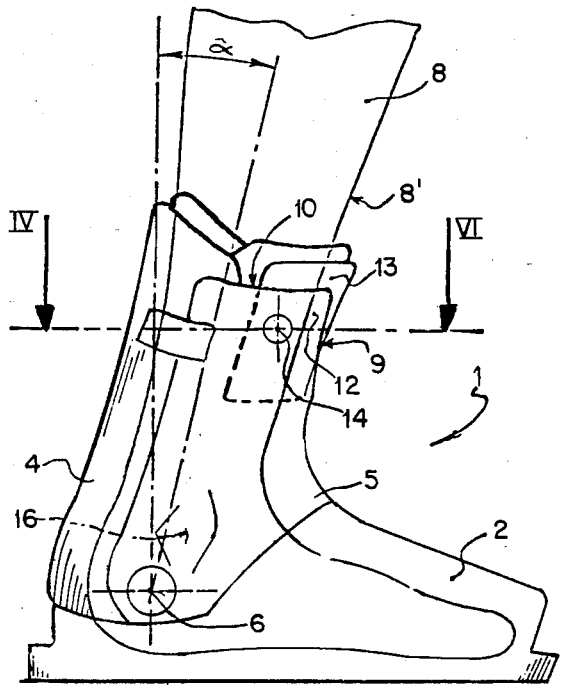
FIG. 2.

FIG. 3.
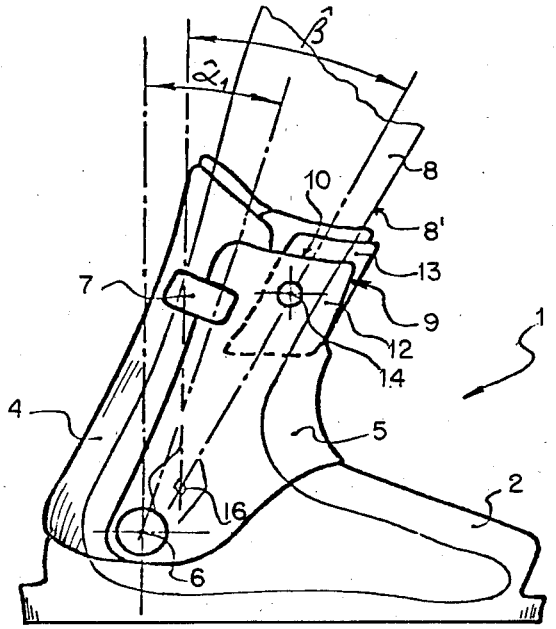
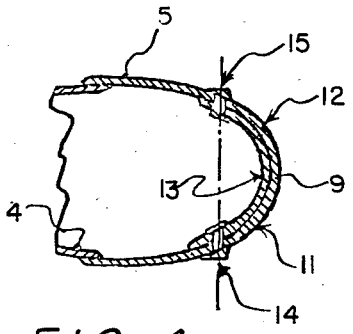
FIG. 4.
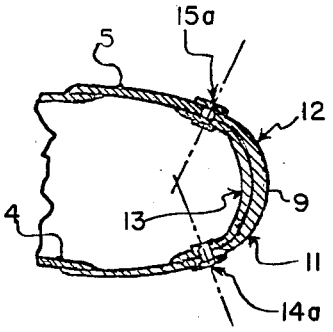
FIG. 4a.

FIG. 10.
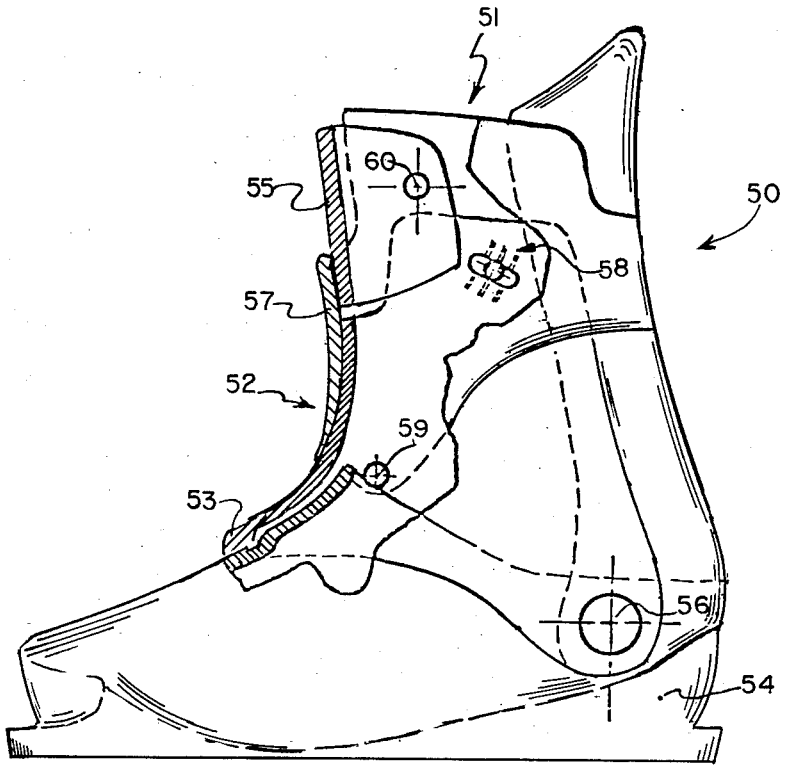
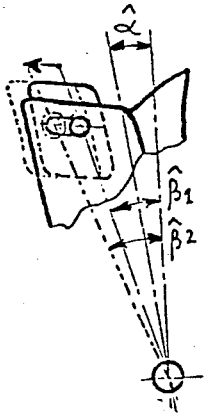
FIG. 11.
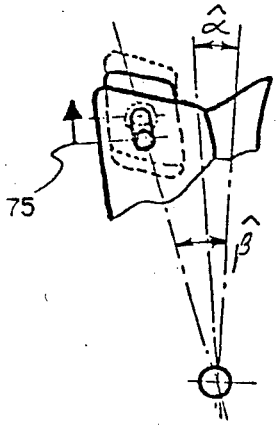
FIG. 12.

SKI BOOT HAVING UPPER WITH JOURNALLED DISTRIBUTION PLATE

BACKGROUND OF THE INVENTION

1. Field of the Invention

The present invention relates to an Alpine ski boot of the rear entrance type comprising apparatus which compensates for the difference in variation of the angle of the leg of a skier with respect to the angle of the ski boot upper.

2. Description of Prior Art

Various types of ski boots are presently available in the market which are adapted to assure that a skier can control the direction of his skis by the use of certain techniques. So as to increase performance when using such techniques, modern ski boots extend to variable heights above the zone of the malleoli of the user to surround the entire base of the leg of the user. However, the materials utilized for forming such ski boots, such as relatively rigid plastic materials, do not allow the skier comfort when used. This is particularly true with ski boots having high uppers, whether or not the uppers are journalled on the shell base of the boot. In effect, to permit the skier to use them in various Alpine ski disciplines, i.e., in competition, along trails, and outside of trails, it is desirable to be able to vary the angle of frontward inclination of such boots. This front angle of inclination is relatively substantial, depending upon the anticipated use of the boot, such as in downhill racing or in off-trail skiing, for example. For this reason, prior art ski boots were made with their uppers journalled on the shell base such that the angle of frontward inclination of the uppers could be varied.

Such boots have been described in German Pat. No. 20 58 969 and in U.S. Pat. No. 3,619,914. However, even though such boots allow for variation of the angle of frontward inclination, they are in most cases uncomfortable with respect to the tibial support of the leg of the skier during frontward flexions of the leg, which are exerted in the course of skiing. This discomfort results precisely from the fact that the journal axis of the upper never corresponds, in practice, with the journal formed by the ankles of the user. This difference between the journal axis of the upper of the boot, and that of the skier, produces, during flexions of the leg of the skier in the boot, a linear contact zone completely around the tibial support area of the leg; this zone is caused by the angular differences between the bottom of the leg and the upper resulting from the lack of alignment of their respective journal axes.

Quite obviously, such disadvantages are even more evident with boots having uppers which are not journalled and in which the foot is inserted from the rear. Thus, manufacturers have attempted to increase the comfort of such boots by providing various apparatus, such as slits on the front of the upper whose spacing is controlled by a movable cursor along the length of these slits, as has been described in German Pat. No. 2,410,063. This type of apparatus does not overcome the problem of discomfort for the tibial support, but only serves to displace the contact zone, and hence the discomfort, as a function of the position of the movable cursor along the front of the upper.

The problem of the leg comfort of the skier is not limited only to frontward flexions, as has already been described in French Pat. No. 2,089,128, in which a pivotable apparatus is provided at the rear of a ski boot having a non-journalled upper such that the leg of the skier does not undergo linear contact, otherwise caused by contact between the upper edge of the upper in the rear frame of the boot and a rear portion of the leg of the skier which would be exerted during skiing. Such pivotable apparatus is designed only to protect the calf of the skier.

SUMMARY OF THE INVENTION

The present invention has as an object to overcome the disdavantages noted above. To this end, a ski boot is provided which is preferably of the type in which the foot of a skier is inserted through the rear, and which preferably compensates for the difference which exists between the actual angulation of the tibia about the malleoli and the angulation of the upper of the boot, which is subjected to frontward flexional movements.

Another objective of the present invention is to provide a ski boot which is comfortable during all of the frontward flexional movements of a skier, even extreme movements, by means of a boot upper which assures the distribution of contact pressures about the tibial support in a constant manner, regardless of the frontward angle of inclination of the journalled upper on the shell base.

To this end, the ski boot according to the present invention comprises a rigid shell base surrounding the foot of the skier and an upper which surrounds the bottom of the leg of the skier. The upper is journalled on the shell base and comprises one or more portions including a groove extending downwardly from the upper edge in the anterior zone of the boot, which provides for tibial support for the bottom of the leg. The boot further comprises a distribution plate which is pressed against the tibia and which pivots around at least one second (additional) journal positioned in the anterior upper zone of the upper. The plate cooperates, at least partially, by means of its exterior wall, with the interior wall of the anterior upper wall of the upper.

The present invention is provided for in a first aspect thereof by a ski boot having a rigid base shell adapted to surround the foot of a skier and an upper adapted to surround the bottom of the leg of the skier. The upper is journalled along a first axis on said shell base and comprises at least two portions, one of said portions in turn comprising means for distributing the contact pressure between the leg and the front upper edge of said upper over a front upper zone of said upper. The distribution means comprises a pressure distribution plate which is pivoted about at least one additional journal axis located along the front upper portion of the front portion of the upper, i.e., the cuff. The distribution plate is positioned within at least a portion of the interior of said upper cuff portion, adjacent to a groove extending downwardly from the upper edge, and is thus adapted to support the tibia of a skier. The plate is attached to the cuff at approximately the midpoint of the plate. The upper includes both the cuff and a rear spoiler, and the ski boot includes a latching hook for tightening the support around the leg. The groove in the cuff portion is located substantially coaxially with the longitudinal median plane of the boot.

The boot also incorporates means for adjusting the position of the at least one additional journal axis at which the distribution plate is pivoted to the cuff. This adjusting means can be adapted to adjust the position of the at least one additional journal axis along a direction which is substantially parallel to the sole of the boot, and for this purpose comprises a guideway and apparatus for locking the axis along the guideway. Alternately, the adjusting means can be adapted to adjust the position of the journal axis along a direction which is substantially parallel to the axis of the upper, and in this case the adjustment means also comprises a guideway and apparatus for locking the axis along the guideway.

The at least one additional axis can comprise pivots located on opposite sides of the groove, and these pivots can either have intersecting axes or coincident axes.

The pivots, or journal axes, can comprise rivets of either metal or plastic, and can be molded integrally with the distribution plate or with the cuff. Each adjusting means can comprise a screw and a threaded bolt which is positioned within apertures in the cuff and in the distribution plate. The adjustment means can also include a screw with projecting teeth which cooperate with an opening in the cuff.

The additional journal axis can comprise a single pivot axis positioned transversely to the longitudinal axis of the boot and substantially tangentially to the anterior generatrix of the cuff. In one case, this single pivot axis can comprise a cylindrical element extending across the groove and having ends which are positioned both within apertures of wings extending outwardly from opposite sides of the groove and within an aperture of a plate projection which is located between the wings. The groove and the plate projection are both substantially V-shaped, and the cylindrical element can comprise a central cylindrical pivot portion and oppositely threaded portions attached to opposed ends of the cylindrical pivot portion. The wing apertures are threaded to engage the oppositely threaded ends of the cylindrical member.

The single pivot axis can alternately comprise a cylindrical rib or bead, which is horizontally located at the bottom of the groove, and a hook attached to the distribution plate. The hook includes a cylindrical opening which is adapted to engage the cylindrical bead, and the bead can be attached to or molded with the cuff.

Alternately, the single pivot axis can comprise a flexible stud extending perpendicularly from the exterior surface of the plate which is adapted to be inserted into an aperture located in the cuff beneath the groove. The flexible stud can be integrally molded with the plate and is rotatable within the cuff and along an axis which is substantially parallel to the plane of the sole of the boot.

The cuff can be formed in two parts, a lower cuff part journalled directly to the shell base and an upper cuff part journalled to the lower cuff part. The position of the journal of the two cuff parts is adjustable, and the distribution plate is journalled on said upper cuff portion by a pair of pivots.

BRIEF DESCRIPTION OF THE DRAWINGS

The invention will now be described with reference to the annexed drawings, shown by way of non-limiting example only, in which:

FIG. 1 is a perspective view of a ski boot according to the invention provided with the upper front portion, i.e., cuff, of its upper having a groove and with a distribution plate journalled around two axes;

FIGS. 2 and 3 illustrate side views of the ski boot of FIG. 1, in its normal stationary position and in its front flexed position, respectively, for purposes of showing the difference in angular position which occurs between the bottom of the leg and the upper;

FIGS. 4 and 4*a* are cross-sectional views, taken along line IV—IV of FIG. 2, showing the various positions of the journal axes with respect to the longitudinal axis;

FIG. 10 illustrates a boot according to the invention shown in partial side cross-section and having a distribution plate which is provided on the front of an upper having several portions, and which additionally allows for adjustment of the inclination and the rigidity of the upper, with a height adjustment apparatus for the distribution plate journal axes, along the length of the tibia of the skier, being provided on both sides of the groove of the upper;

FIGS. 11 and 12 schematically illustrate two apparatus for adjusting the position of the journal pivots of a distribution plate;

DESCRIPTION OF PREFERRED EMBODIMENTS

Figure 5:
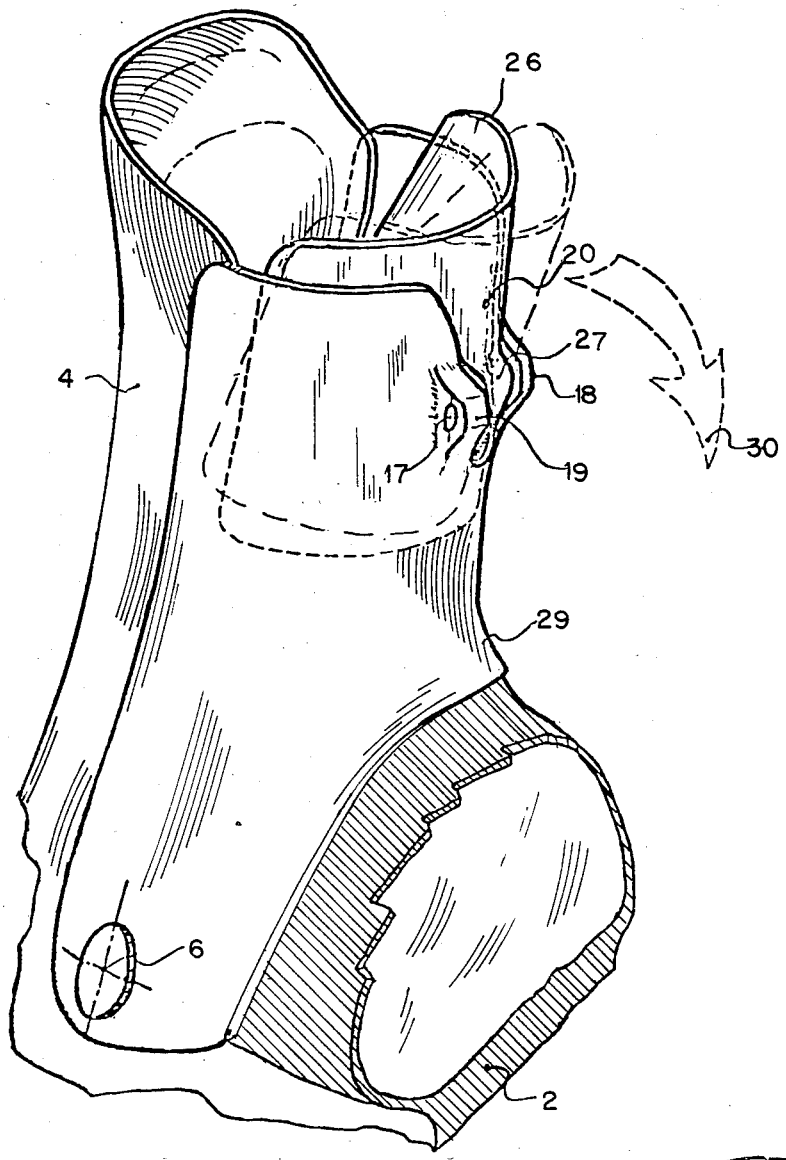
FIGS. 5 and 5*a* are partial perspective views of the upper of a boot provided with a journalled distribution plate according to the present invention, the journal of the distribution plate being tangential to the front of the upper.

Numerous embodiments are possible according to the present invention.

According to one embodiment a boot is provided whose upper is journalled on the shell base and comprises, along its upper front portion, i.e., its cuff, a second upper portion in the form of a spout comforming substantially to the shape of the tibial support of the leg of a skier; the plate itself can be journalled by two journal axes, situated on both sides of the median longitudinal plane of the boot, such that the spout serves as a force or pressure distribution plate mounted to equalize pressure, and pivots with respect to the entire journalled upper.

According to yet another embodiment of a journalled upper with a pivoted distribution plate, it is possible to replace the two journal axes of the plate by a single axis situated tangentially with respect to the periphery of the upper and at right angles to the lower portion of a groove provided on the front of the upper, the groove beginning at the upper edge of the upper, and enhancing the angular flexion of the pressure equalizer during pronounced frontward flexional movements. It is obvious that this groove is not limited only for use with the embodiment described, but that it is an important element for the operation of all of the embodiments of the boot according to the present invention. Furthermore, all possible groove configurations are contemplated, e.g., narrow, wide, V-shaped, trapezoidal, etc., as a function of the rigidity and/or flexibility of the materials utilized, both for the shaft and for the pressure equalizer.

FIGS. 1–3 show an embodiment of the invention in which ski boot 1 comprises a shell base 2 made of rigid plastic material, on which an upper 3 is journalled and which surrounds the bottom of the leg of a skier. Upper 3 is itself composed of a rear spoiler 4, surrounding the rear of the bottom of the leg of the skier, and a front anterior portion, known as a cuff 5, surrounding the front of the bottom of the leg. Rear spoiler 4 and cuff 5 are, in the constructional embodiment described, simultaneously journalled on the same journal axis 6, which is situated approximately at the part of the shell base which corresponds to the zone of the malleoli of the skier. Furthermore, a latching hook 7, on cuff 5, is schematically shown and allows for the tightening of upper 3 on the base of leg 8 of the skier. Upper 3 comprises, along its upper portion, a cut away groove 9 which begins at the upper edge 10 of cuff 5; the groove extends downwardly and is situated coaxially with respect to the longitudinal median plane of the boot. Groove 9 thus defines, at the top of cuff 5, two portions 11 and 12 which are more flexible and deformable than the remainder of the assembly of upper 3. A curved distribution plate 13, substantially in the shape of a spout, covers the groove 9, beginning on the interior of cuff 5, such that it is pressed against the tibial support zone 8' of the bottom of the leg of the skier. Distribution plate 13 is pivotably connected to the top of cuff 5 on both sides of groove 9 by means of journal axes 14 and 15. These journal axes are preferably positioned at the mid-length of distribution plate 13, and allow for the rotation of the plate frontwardly in the case of a frontward flexion (as seen in FIG. 3). Journal axes 14 and 15 can be provided, e.g., by means of rivets having extra flat heads made of metal or plastic material, etc. They can be molded with the distribution plate or with the top of the cuff, respectively, in the form of cylindrical clippable heads, and will be formed in either the distribution plate or cuff, depending upon the embodiment.

In the normal static position of the boot, as shown in FIG. 2, the base of leg 8 of the skier is maintained in the boot upper 3, which has been previously provided with a slipper (not shown), in an advanced position thereof, as shown by the angle alpha which it forms with respect to the vertical of the plane of the sole of the boot. Distribution plate 13, located at the front of cuff 5, positions itself in tibial support zone 8' of the base of the leg, with the same angular orientation as the assembly of upper 3.

As soon as the skier exerts a frontward flexion (see FIG. 3), the upper assembly pivots around journal 6 of the shell base 2 over a new advancement angle $alpha_1$, the angle $alpha_1$ being greater than the angle alpha at the rest position. Thus, the flexional force results in the rotation of upper 3 around an axis fixed on the shell base and in an angular movement of the bottom of the leg 8 on the malleoli journal 16, whose center of rotation moves as a function of the amplitude of flexional movement. As a result, for a given value of advancement angle $alpha_1$ of the upper, the bottom of the leg describes an angle having a value beta which is greater than $alpha_1$. Without pivotable distribution plate 13 the leg bottom 8 would be made to undergo a linear contact along the upper edge 10 of cuff 5. By virtue of the inventive arrangement this does not occur. In effect, distribution plate 13 serves as a pressure equalizer, and makes it possible for the tibial support 8' of the bottom of the leg to distribute the flexional force along a contact surface or zone whose orientation exactly matches that assumed by the leg. Thus, by means of an additional (second) journal axis, provided at the top of the front upper, distribution plate 13 follows the inclinations of the leg 8 while compensating for the difference of inclination assumed by upper 3.

Furthermore, this construction according to the invention additionally assures the comfort of the user, a technical effect which is appreciated by the skier with respect to the stiffness of the upper. Thus, when the skier exerts repeated flexions when passing over a field of bumps, the skier permanently maintains the feeling of contact with his boot regardless of the flexional amplitude of the upper, whose lateral portions 11 and 12 are spaced more or less as a function of the force of the frontward pivoting of distribution plate 13. The elasticity of the cuff, due to the material from which it is made, allows it to serve as a shock absorbing spring, for the particular zone at the front top of the upper which is biased to a degree dependent upon the amplitude of its flexional movements. Finally, the elastic blades, represented by lateral portions 11 and 12, also serve to bias the boot back to its normal rest position as soon as the skier ceases to flex his legs, by virtue of the elasticity and the contour of the cuff. This elastic bias is accentuated by the position of journals **14*a* and 15*a*, whose axes intersect (see FIG. 4*a*), which is contrary to the embodiment shown in FIG. 4, where the journal pivots 14 and 15 have axes which are coextensive. The advantage of an embodiment such as is shown in FIG. 4*a* resides in the fact that the elastic bias of the top of the upper is not limited only to the temporary deformation of lateral portions 11 and 12 of cuff 5, but also includes an energization force at the level of journal pivots 14*a* and 15*a*, which are positioned in unstable positions during flexional forces by virtue of their intersecting axes. Of course, the position of journal pivots 14, 15 and 14*a*, 15*a*** in the zone of the top of the upper can likewise be adjustable by displacing these pivots, either along slots or guideways which are substantially parallel to the plane of the sole, or along slots or guideways which are substantially parallel to the axis of the upper.

In the former case, in which the adjustment is parallel to the plane of the sole, the embodiment relies upon a guide in which the journal pivots for the distribution plate slide and which are subsequently fixed, in a selected position, to assure the possibility of adjusting the initial angle of advancement of the leg without affecting the angle of the upper. The schematic indicated in FIG. 11 illustrates this possibility. It should be noted that for each possible position of journal pivots 14 and 15, or **14*a* and 15*a***, within the guideway, the distribution plate evidently preserves its ability to orient itself around the pivots, depending upon the morphology of the leg. Thus, it is noted that the advancement angle of the leg can be changed from $beta_1$ to $beta_2$, dependent upon where one positions the pivots in the guideway, while the angle alpha, i.e., the position of the main upper, remains unchanged.

Thus, independence of the possibilities of variations in the advancement angle of the leg with respect to the shell base can be achieved, thus preferably preserving the flexional and rigidity properties of the upper in different positions of the leg.

In the latter case, concerning an adjustment slit generally parallel to the axis of the upper, a slot or guideway is utilized in which the journal pivots of the distribution plate slide in a fashion identical to that described above. The difference resides in the approximately vertical orientation of the guideway, as best seen in FIG. 12. The possibilities of adjusting the advancement angle of the leg are slightly diminished in this embodiment, but are compensated for by the ease of adjusting the height of the distribution plate along the tibial edge of the skier, as indicated by arrow 75. This ease of height adjustment increases, to a substantial extent, the comfort of a skier during use, as it permits the skier to regulate and adapt the position of the plate depending upon the situation and the morphology of his tibial support.

Figure 5A:
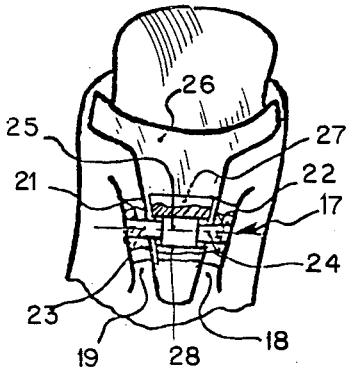

FIGS. 5 and 5*a* illustrate an embodiment different from those previously discussed, in that it comprises a single journal pivot 17 positioned tangentially to the tibial support zone. To achieve this, the edges of cutaway groove 20 of cuff 29 are provided with wings 18 and 19, in which threaded bores 21 and 22 are provided which are adapted to receive pivot 17; the pivot is threaded in the opposite direction at its two ends 23 and 24 while its central portion 25 is cylindrical. Central portion 25 serves as a journal for distribution plate 26, which is provided with a projection or embossment 27 having the same angle as the V-shaped groove in which it is positioned. Projection 27 is provided with a cylindrical opening 28 having a diameter substantially equal to the diameter of the central portion of the journal pivot. Distribution plate 26, positioned on the interior of upper cuff 29, pivots frontwardly as soon as the skier exerts a flexion along the direction of arrow 30, the rigidity of whose support is controlled by the cooperation of the sides of corner projection 27 with wings 18 and 19, which form a V bordering the cut-away groove. Under the action of this flexion, corner 27 spaces grooves 18 and 19, which due to the nature of the materials forming the projection and grooves, provides a certain resistance against deformation. In this system the two oppositely threaded portions 23 and 24 preferably allow for adjustment of the spacing of grooves 18 and 19; this permits, as a result, modulation of the variation of the rigidity and of the amplitude of the actual advancement angle of the leg in the upper. It is evident that the adjustment means described are not the only such means which could be used, and it is possible to adapt any equivalent means which would serve to space the grooves while using this general type of construction.

FIGS. 6–9 illustrate two other embodiments of a single second journal point of an upper which is itself journalled on a ski boot shell base, according to the invention. These embodiments operate on the principle discussed above, i.e., a distribution plate is journalled on the top of the upper by a single journal pivot which is positioned transversely to the longitudinal axis of the shoe and tangentially to the tibial support zone.

Figure 6:
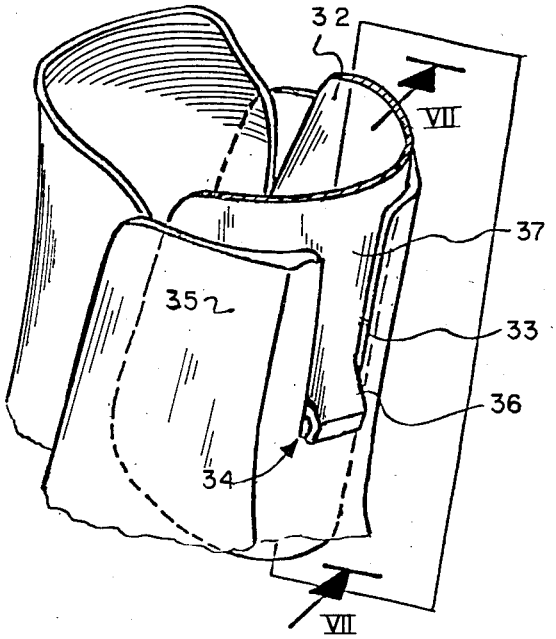
FIGS. 6 and 7 illustrate, in perspective view and in partial cross-section, respectively, another embodiment of the tangential journal of a distribution plate to the upper, the distribution plate being clipped onto the end of the front groove of the upper.
Figure 7:
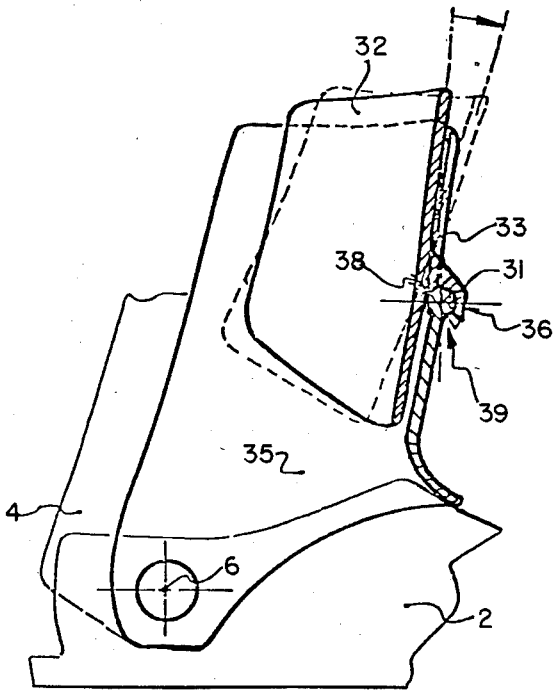

More precisely, FIGS. 6 and 7 illustrate an embodiment where the journal pivot of distribution plate 32 is obtained by using a cylindrically configurated bead 31 provided at end 34 of cut-away groove 33, the groove having a U-shape which is cut away at the top of the front of upper cuff 35. This cylindrical bead 31 is molded as a single piece with cuff 35. It can alternately be attached by assembly, using known apparatus, e.g., with a metallic part. The distribution plate 32 comprises, near the middle of its length, a projection 36 (which is either molded on the plate or applied to the plate after molding) on its anterior surface 37; this projection is provided with a transverse opening 38 having the same dimension as the cylindrical bead 31. Opening 38 has an exterior opening 39 whose dimension is less than that of the diameter of the bead, such that the projection 36 will surround bead 31 upon assembly of the distribution plate and cuff, so as to comprise the second journal of the upper, according to the present invention.

Figure 8:
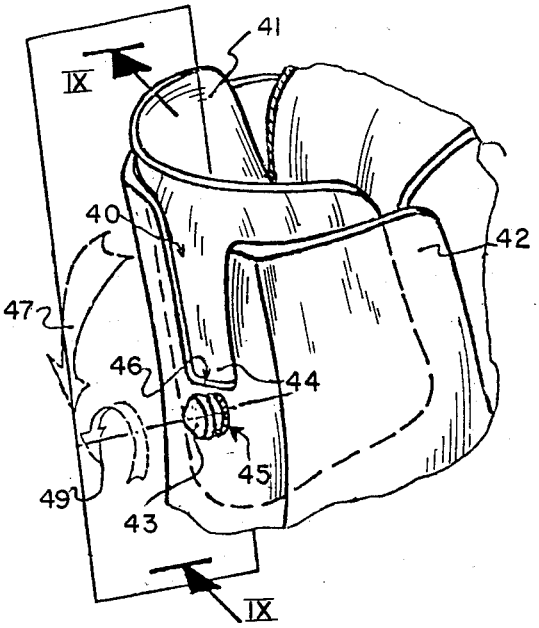
FIGS. 8 and 9 likewise show another alternative embodiment showing a distribution plate tangentially journalled to the upper under the front groove of the upper. This embodiment, furthermore, permits orientation of the distribution plate along a rotational axis which is substantially perpendicular to the front zone of the upper of the boot.
Figure 9:
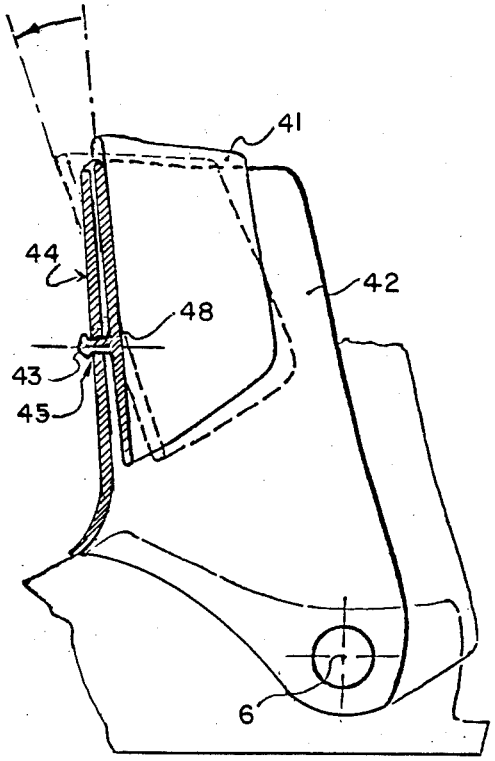

FIGS. 8 and 9 illustrate a version similar to that described previously except that groove 40, which is shown as having a U-shape, can have other cutaway configurations. In this embodiment, distribution plate 41 is clipped within upper 42. As in the preceding embodiment, the deformational properties of the plastic materials used is sufficient to provide a type of frictional journal axis. In effect, plate 41 comprises, along its central portion, a head 43 projecting perpendicularly to its external surface 44, which is adapted to be clipped into hole 45. The head is positioned just under the lower edge 46 of cutaway groove 40 on the cuff such that it can undergo angular frontward bending which is necessary during flexions exerted by the skier (in the direction of arrow 47). During such flexion, head 43 is subjected to bending deformation, which defines a flexional zone 48 forming the journal axis. Of course, the material utilized for this embodiment must be adapted to resist such bias. Furthermore, the cylindrical cross-section of head 43 preferably allows distribution plate 41 to be rotatable around the axis of the head (according to arrow 49). This means that plate 41 has the ability to orient itself, within limits created by the walls of the cuff, and as a result can perfectly adapt itself to various morphologies of skiers having arched legs or other anomalies of this type. It is likewise possible to provide apparatus for adjusting the height of implantation of the plate in this type of embodiment by replacing the cylindrical hole with an oblong slit positioned perpendicularly to the longitudinal median plane of the boot. This slit would thus receive a locking apparatus which would allow attachment of the head along a selected position along the length of the slot. Such an apparatus is described in detail with reference to FIG. 13 and is applicable in an embodiment having two journal pivots.

FIG. 10 illustrates a preferred embodiment of a boot 50 according to the invention whose upper 51 has a two journal pivots and which comprises a two part cuff 52. These parts include a lower cuff portion 53, cooperating directly with the shell base 54 by means of journal axis 56, which allows for flexions of the leg of the skier, and an upper cuff portion 57 cooperating with portion 53 by means of an apparatus for adjusting the initial advancement of the upper itself. This adjustment apparatus comprises a journalled linkage 59 of upper portion 57 on lower portion 53, and a locking system 58 for setting the angular variation of the two portions on one another.

Finally, a distribution plate 55 is journalled on upper cuff portion 57 by means of two pivots 60, in accordance with one of the embodiments as described with reference to FIGS. 1–4*a*, 11 and 12.

Figure 13:
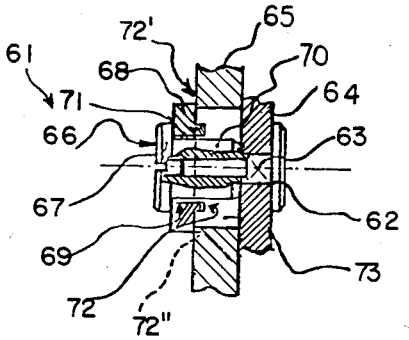
FIG. 13 is a in detailed cross-sectional view of an adjustment apparatus for a journal pivot.

FIG. 13 illustrates in detail one such nonlimiting embodiment of locking means for blocking the adjustment guideway at a position along the length of the slide, and it comprises adjustment apparatus 61 for the journal of a distribution plate. Thus, for example, a threaded bolt 62 provided with a rotational blocking element 63 extends through the wall of distribution plate 64 as well as through cuff 65, which is tightened against plate 64 by a cylindrical screw 66 whose head 67 maintains a positioning plate 68 against the cuff. To permit rotation of plate 64 around the journal axis, plate 68 includes a hole 69 allowing free movement of the cylindrical body 70 of the screw. Finally, a projecting tooth 71 cooperates with a corresponding opening 72 of cuff 65 on both sides of oblong slit 73, in which cylindrical body 70 of the screw can be moved. To change the position of the journal axis one unscrews screw 66 to disengage tooth 71 from cuff opening 72, and the screw-bolt-plate assembly 62, 66, and 68 is displaced to move plate 64 to one end of oblong slit 73; and the screw is then tightened such that teeth 71 are engaged in opening 72' or 72'', positioned towards the ends of the slit.

Figure 14:
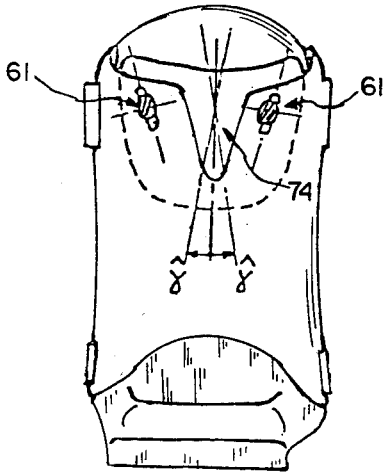
FIG. 14 illustrates the possibility of modifying the position of the distribution plate with respect to the median axis of the boot, according to the present invention.

FIG. 14 illustrates a boot according to the invention in which adjustment apparatus 61 are placed on each side of cuff groove 74 and additionally allow for orientation of the distribution plate with respect to the median axis of the shoe upper (referenced by angles gamma).

Although the invention has been described with reference to particular means, materials and embodiments, it is to be understood that the invention is not limited to the particulars disclosed but extends to all equivalents encompassed within the scope of the claims.

What is claimed is:

1. A ski boot having a rigid shell base adapted to surround the foot of the skier and an upper adapted to surround the bottom of the leg of the skier, wherein said upper comprises a front cuff, wherein said front cuff is journaled along a first axis on said shell base, wherein said upper further comprises means for distributing the contact pressure between the leg and the front upper edge of the upper over a front upper zone of said upper, wherein said distribution means comprises a pressure distribution plate which is journaled about at least one additional axis located on said front cuff at said front upper zone.

2. A ski boot in accordance with claim 1 wherein said distribution plate is positioned within at least a portion of the interior of said cuff, adjacent to a groove in said cuff which extends downwardly from said upper edge, said distribution plate being thereby adapted to support the tibia of said skier.

3. A ski boot in accordance with claim 2 wherein said distribution plate is attached to said cuff along the at least one additional axis at approximately the midlength portion of said plate.

4. A ski boot in accordance with claim 2 wherein said upper further comprises a rear spoiler which is journalled to said base shell along said first axis.

5. A ski boot in accordance with claim 4 comprising a latching hook on said upper for tightening said spoiler and cuff around said leg.

6. A ski boot in accordance with claim 2 wherein said groove is located substantially coaxially with the longitudinal median plane of said boot.

7. A ski boot in accordance with claim 2 further comprising means for adjusting the position of the at least one additional journal axis at which the distribution plate is pivoted to said cuff.

8. A ski boot in accordance with claim 7 wherein said position adjusting means are adapted to adjust the position of said additional journal axis along a direction substantially parallel to the sole of said boot.

9. A ski boot in accordance with claim 8 wherein said position adjustment means comprises a guideway and apparatus for locking the axis along said guideway.

10. A ski boot in accordance with claim 7 wherein said position adjusting means are adapted to adjust the position of said journal axis along a direction substantially parallel to the axis of said upper.

11. A ski boot in accordance with claim 10 wherein said position adjustment means comprises a guideway and apparatus for locking the axis along said guideway.

12. A ski boot in accordance with claim 7 wherein said at least one additional axis comprise two axes in the form of pivots located on opposite sides of said groove.

13. A ski boot in accordance with claim 12 wherein said pivots have intersecting axes.

14. A ski boot in accordance with claim 12 wherein said pivots have coincident axes.

15. A ski boot in accordance with claim 12 wherein each of said pivots comprises a screw and a threaded bolt positioned within apertures in said cuff and in said distribution plate.

16. A ski boot in accordance with claim 15 wherein said screw comprises projecting teeth which cooperate with said cuff aperture.

17. A ski boot in accordance with claim 2 wherein said at least one additional axis comprises a single pivot axis positioned transversely to the longitudinal axis of said boot and substantially tangentially to the anterior generatrix of the cuff.

18. A ski boot in accordance with claim 17 wherein said single pivot axis comprises a cylindrical element extending across said groove and having ends which are positioned within apertures in wings extending outwardly from opposite sides of said groove and within a projection of said plate which is located between said wings.

19. A ski boot in accordance with claim 18 wherein said groove and said plate projection are both substantially V-shaped.

20. A ski boot in accordance with claim 19 wherein said cylindrical element comprises a central cylindrical pivot portion and wherein said ends comprise oppositely threaded portions attached to said cylindrical pivot portion.

21. A ski boot in accordance with claim 20 wherein said wing apertures are threaded to engage said oppositely threaded ends.

22. A ski boot in accordance with claim 17 wherein said single pivot axis comprises a cylindrical bead horizontally located at the bottom of said groove and a hook attached to said distribution plate, said hook including a cylindrical opening which is adapted to engage said cylindrical bead.

23. A ski boot in accordance with claim 22 wherein said bead is molded integrally with said upper.

24. A ski boot in accordance with claim 23 wherein said cylindrical bead is attached to said cuff.

25. A ski boot in accordance with claim 17 wherein said single pivot axis comprises a flexible stud extending perpendicularly from the exterior surface of said plate, said stud adapted to be inserted into an aperture located in said cuff beneath said groove.

26. A ski boot in accordance with claim 25 wherein said flexible stud is integrally molded with said plate.

27. A ski boot in accordance with claim 25 wherein said plate is rotatable about the stud within said cuff and along an axis which is substantially parallel to the plane of the sole of the boot.

28. A ski boot in accordance with claim 25 wherein said stud is attached to the plate after molding.

29. A ski boot in accordance with claim 2 wherein each additional axis comprises a rivet.

30. A ski boot in accordance with claim 29 wherein each rivet is molded with said distribution plate.

31. A ski boot in accordance with claim 29 wherein each rivet is molded with said cuff.

32. A ski boot in accordance with claim 2 wherein said cuff includes two parts, a lower cuff part journalled directly to said shell base, and an upper cuff part journalled to said lower cuff part.

33. A ski boot in accordance with claim 32, wherein said cuff parts are journalled to each other along an adjustable axis.

34. A ski boot in accordance with claim 33, wherein said distribution plate is pivotably journalled on said upper cuff part along two axes.

35. The ski boot defined by claim 1 wherein said one additional axis is oriented such that said pressure distribution plate flexes forward to substantially the same extent as said leg of said skier when said leg flexes forward in said boot.

36. A ski boot having a rigid shell base adapted to surround the foot of a skier and an upper adapted to surround the bottom of the leg of the skier, wherein said upper comprises a front cuff, wherein said front cuff is journalled along a first axis on said shell base, wherein said upper further comprises means for distributing the contact pressure between the leg and the front upper edge of said upper over a front upper zone of said upper, wherein said first axis is misaligned with a journal axis of said leg of said skier around which said leg of said skier is adapted to pivot during forward flexion, wherein for a given forward flexion of said leg, said leg pivots forward to a greater extent than said front cuff, wherein said distribution means further comprises means for compensating for said misalignment of said journal axis of said front cuff and said journal axis of said leg so that said front upper zone of said upper flexes forward to substantially the same degree as said leg during forward flexion of said leg.

37. The ski boot to find claim 36 wherein said compensation means comprises a pressure distribution plate which is journaled around at least one additional axis located on said front cuff of said front upper zone.

* * * * *